US008020471B2

(12) United States Patent
Hall et al.

(10) Patent No.: US 8,020,471 B2
(45) Date of Patent: Sep. 20, 2011

(54) METHOD FOR MANUFACTURING A DRILL BIT

(75) Inventors: David R. Hall, Provo, UT (US); Ronald Crockett, Payson, UT (US); John Bailey, Spanish Fork, UT (US)

(73) Assignee: Schlumberger Technology Corporation, Houston, TX (US)

( * ) Notice: Subject to any disclaimer, the term of this patent is extended or adjusted under 35 U.S.C. 154(b) by 160 days.

(21) Appl. No.: 12/395,249

(22) Filed: Feb. 27, 2009

(65) Prior Publication Data

US 2009/0158897 A1 Jun. 25, 2009

Related U.S. Application Data

(60) Division of application No. 11/750,700, filed on May 18, 2007, now Pat. No. 7,549,489, which is a continuation-in-part of application No. 11/737,034, filed on Apr. 18, 2007, now Pat. No. 7,503,405, which is a continuation-in-part of application No. 11/686,638, filed on Mar. 15, 2007, now Pat. No. 7,424,922, which is a continuation-in-part of application No. 11/680,997, filed on Mar. 1, 2007, now Pat. No. 7,419,016, which is a continuation-in-part of application No. 11/673,872, filed on Feb. 12, 2007, now Pat. No. 7,484,576, which is a continuation-in-part of application No. 11/611,310, filed on Dec. 15, 2006, now Pat. No. 7,600,586, which is a continuation-in-part of application No. 11/278,935, filed on Apr. 6, 2006, now Pat. No. 7,426,968, which is a continuation-in-part of application No. 11/277,394, filed on Mar. 24, 2006, now Pat. No. 7,398,837, which is a continuation-in-part of application No. 11/277,380, filed on Mar. 24, 2006, now Pat. No. 7,337,858, which is a continuation-in-part of application No. 11/306,976, filed on Jan. 18, 2006, now Pat. No. 7,360,610, which is a continuation-in-part of application No. 11/306,307, filed on Dec. 22, 2005, now Pat. No. 7,225,886, which is a continuation-in-part of application No. 11/306,022, filed on Dec. 14, 2005, now Pat. No. 7,198,119, which is a continuation-in-part of application No. 11/164,391, filed on Nov. 21, 2005, now Pat. No. 7,270,196.

(51) Int. Cl.

| | |
|---|---|
| ***B21K 5/04*** | (2006.01) |
| *E21B 10/26* | (2006.01) |
| *E21B 10/54* | (2006.01) |

(52) U.S. Cl. ..... 76/108.2

(58) Field of Classification Search ..... D15/139; 76/108.1–108.6; 175/385, 426, 433–435
See application file for complete search history.

(56) References Cited

U.S. PATENT DOCUMENTS 465,103 A 12/1891 Wegner
(Continued)

*Primary Examiner* — Jason Daniel Prone
(74) *Attorney, Agent, or Firm* — Brinks Hofer Gilson & Lione

(57) ABSTRACT

In one aspect of the present invention, a drill bit has a body intermediate a shank and a working face, the working face comprising a plurality of blades formed on the working face and extending outwardly from the bit body. Each blade comprises at least one cutting element. The drill bit also has a jack element coaxial with an axis of rotation and extending out of an opening formed in the working face. A portion of the jack element is coated with a stop-off.

17 Claims, 8 Drawing Sheets

U.S. PATENT DOCUMENTS

| | | | | |
|---|---|---|---|---|
| 590,113 | A | | 9/1897 | Prindle |
| 616,118 | A | | 12/1898 | Kuhne |
| 946,060 | A | | 1/1910 | Looker |
| 1,116,154 | A | | 11/1914 | Stowers |
| 1,183,630 | A | | 5/1916 | Bryson |
| 1,189,560 | A | | 7/1916 | Gondos |
| 1,360,908 | A | | 11/1920 | Everson |
| 1,372,257 | A | | 3/1921 | Swisher |
| 1,387,733 | A | | 8/1921 | Midgett |
| 1,460,671 | A | | 7/1923 | Hebsacker |
| 1,544,757 | A | | 7/1925 | Hufford |
| 1,746,455 | A | | 2/1930 | Woodruff, et al. |
| 1,821,474 | A | | 9/1931 | Mercer |
| 1,836,638 | A | | 12/1931 | Bonney |
| 1,879,177 | A | | 9/1932 | Gault |
| 2,022,101 | A | | 11/1935 | Wright |
| 2,054,255 | A | | 9/1936 | Howard |
| 2,064,255 | A | | 12/1936 | Garfield |
| 2,169,223 | A | | 8/1939 | Christian |
| 2,218,130 | A | | 10/1940 | Frederick |
| 2,320,136 | A | | 5/1943 | Kammerer |
| 2,345,024 | A | | 3/1944 | Bannister |
| 2,371,248 | A | | 3/1945 | Mcnamara |
| 2,466,991 | A | | 4/1949 | Kammerer |
| 2,540,464 | A | | 2/1951 | Stokes |
| 2,544,036 | A | | 3/1951 | Mccann |
| 2,545,036 | A | | 3/1951 | Kammerer |
| 2,575,173 | A | | 11/1951 | Johnson |
| 2,619,325 | A | | 11/1952 | Arutunoff |
| 2,626,780 | A | | 1/1953 | Ortloff |
| 2,643,860 | A | | 6/1953 | Koch |
| 2,725,215 | A | | 11/1955 | Macneir |
| 2,755,071 | A | | 7/1956 | Kammerer, Jr. |
| 2,776,819 | A | | 1/1957 | Brown |
| 2,819,041 | A | | 1/1958 | Beckham |
| 2,819,043 | A | | 1/1958 | Henderson |
| 2,838,284 | A | | 6/1958 | Austin |
| 2,873,093 | A | | 2/1959 | Hildebrandt |
| 2,877,984 | A | | 3/1959 | Causey |
| 2,894,722 | A | | 7/1959 | Buttolph |
| 2,901,223 | A | | 8/1959 | Scott |
| 2,942,850 | A | | 6/1960 | Heath |
| 2,963,102 | A | | 12/1960 | Smith |
| 2,998,085 | A | | 8/1961 | Dulaney |
| 3,036,645 | A | | 5/1962 | Scott |
| 3,055,443 | A | | 9/1962 | Edwards |
| 3,058,532 | A | | 10/1962 | Lee |
| 3,075,592 | A | | 1/1963 | Cannon |
| 3,077,936 | A | | 2/1963 | Arutunoff |
| 3,135,341 | A | | 6/1964 | Ritter |
| 3,139,147 | A | | 6/1964 | Hays |
| 3,163,243 | A | | 12/1964 | Cleary |
| 3,216,514 | A | | 11/1965 | Nelson |
| 3,294,186 | A | | 12/1966 | Buell |
| 3,301,339 | A | | 1/1967 | Pennebaker, Jr. |
| 3,379,264 | A | | 4/1968 | Cox |
| 3,429,390 | A | | 2/1969 | Bennett |
| 3,433,331 | A | | 3/1969 | Heyberger |
| 3,455,158 | A | | 7/1969 | Richter |
| 3,493,165 | A | | 2/1970 | Schonfeld |
| 3,583,504 | A | | 6/1971 | Aalund |
| 3,635,296 | A | | 1/1972 | Lebourg |
| 3,732,143 | A | | 5/1973 | Joosse |
| 3,764,493 | A | | 10/1973 | Nicks et al. |
| 3,815,692 | A | | 6/1974 | Varley |
| 3,821,993 | A | | 7/1974 | Kniff et al. |
| 3,899,033 | A | | 8/1975 | Van Huisen et al. |
| 3,955,535 | A | | 5/1976 | Stock |
| 3,960,223 | A | | 6/1976 | Kleine |
| 4,081,042 | A | | 3/1978 | Johnson |
| 4,096,917 | A | | 6/1978 | Harris |
| 4,106,577 | A | | 8/1978 | Summers |
| 4,176,723 | A | | 12/1979 | Arceneaux |
| 4,253,533 | A | | 3/1981 | Baker |
| 4,262,758 | A | | 4/1981 | Evans |
| 4,280,573 | A | | 7/1981 | Sudnishnikov et al. |
| 4,304,312 | A | | 12/1981 | Larsson |
| 4,307,786 | A | | 12/1981 | Evans |
| 4,386,669 | A | | 6/1983 | Evans |
| 4,397,361 | A | | 8/1983 | Langford |
| 4,416,339 | A | | 11/1983 | Baker |
| 4,445,580 | A | | 5/1984 | Sahley |
| 4,448,269 | A | | 5/1984 | Ishikawa et al. |
| 4,478,296 | A | | 10/1984 | Richman |
| 4,499,795 | A | | 2/1985 | Radtke |
| 4,531,592 | A | | 7/1985 | Hayatdavoudi |
| 4,535,853 | A | * | 8/1985 | Ippolito et al. ..... 175/420.1 |
| 4,538,691 | A | | 9/1985 | Dennis |
| 4,566,545 | A | | 1/1986 | Story et al. |
| 4,574,895 | A | | 3/1986 | Dolezal |
| 4,583,592 | A | | 4/1986 | Gazda et al. |
| 4,597,454 | A | | 7/1986 | Schoeffler |
| 4,612,987 | A | | 9/1986 | Cheek |
| 4,624,306 | A | | 11/1986 | Traver et al. |
| 4,637,479 | A | | 1/1987 | Leising |
| 4,640,374 | A | | 2/1987 | Dennis |
| 4,679,637 | A | | 7/1987 | Cherrington |
| 4,683,781 | A | * | 8/1987 | Kar et al. ..... 76/108.2 |
| 4,694,913 | A | | 9/1987 | McDonald et al. |
| 4,775,017 | A | | 10/1988 | Forrest et al. |
| 4,836,301 | A | | 6/1989 | Van Dongen |
| 4,852,672 | A | | 8/1989 | Behrens |
| 4,889,017 | A | | 12/1989 | Fuller et al. |
| 4,907,665 | A | * | 3/1990 | Kar et al. ..... 175/426 |
| 4,924,499 | A | | 5/1990 | Serby |
| 4,962,822 | A | | 10/1990 | Pascale |
| 4,974,688 | A | | 12/1990 | Helton |
| 4,981,184 | A | | 1/1991 | Knowlton et al. |
| 4,991,667 | A | | 2/1991 | Wilkes et al. |
| 5,009,273 | A | | 4/1991 | Grabinski |
| 5,027,914 | A | | 7/1991 | Wilson |
| 5,038,873 | A | | 8/1991 | Jurgens |
| 5,052,503 | A | | 10/1991 | Lof |
| 5,088,568 | A | | 2/1992 | Simuni |
| 5,094,304 | A | | 3/1992 | Briggs |
| 5,103,919 | A | | 4/1992 | Warren |
| 5,119,892 | A | | 6/1992 | Clegg et al. |
| 5,135,060 | A | | 8/1992 | Ide |
| 5,141,063 | A | | 8/1992 | Quesenbury |
| 5,148,875 | A | | 9/1992 | Karlsson et al. |
| 5,176,212 | A | | 1/1993 | Tandberg |
| 5,186,268 | A | | 2/1993 | Clegg |
| 5,222,566 | A | | 6/1993 | Taylor |
| 5,255,749 | A | | 10/1993 | Bumpurs |
| 5,259,469 | A | | 11/1993 | Stjernstrom |
| 5,265,682 | A | | 11/1993 | Russell |
| 5,311,953 | A | | 5/1994 | Walker |
| 5,314,030 | A | | 5/1994 | Peterson |
| 5,361,859 | A | | 11/1994 | Tibbitts |
| 5,388,649 | A | | 2/1995 | Ilomaki |
| 5,410,303 | A | | 4/1995 | Comeau et al. |
| 5,417,292 | A | | 5/1995 | Polakoff |
| 5,423,389 | A | | 6/1995 | Warren |
| 5,475,309 | A | | 12/1995 | Hong |
| 5,507,357 | A | | 4/1996 | Hult |
| 5,553,678 | A | | 9/1996 | Barr et al. |
| 5,560,440 | A | | 10/1996 | Tibbitts |
| 5,568,838 | A | | 10/1996 | Struthers |
| 5,655,614 | A | | 8/1997 | Azar |
| 5,678,644 | A | | 10/1997 | Fielder |
| 5,720,355 | A | | 2/1998 | Lamine et al. |
| 5,728,420 | A | | 3/1998 | Keogh |
| 5,732,784 | A | * | 3/1998 | Nelson ..... 175/385 |
| 5,778,991 | A | | 7/1998 | Runquist et al. |
| 5,794,728 | A | * | 8/1998 | Palmberg ..... 175/400 |
| 5,833,021 | A | * | 11/1998 | Mensa-Wilmot et al. .... 175/433 |
| 5,896,938 | A | | 4/1999 | Moeny et al. |
| 5,904,444 | A | | 5/1999 | Kabeuchi et al. |
| 5,924,499 | A | | 7/1999 | Birchak et al. |
| 5,947,215 | A | | 9/1999 | Lundell |
| 5,950,743 | A | | 9/1999 | Cox |
| 5,957,223 | A | | 9/1999 | Doster et al. |
| 5,957,225 | A | | 9/1999 | Sinor |
| 5,967,247 | A | | 10/1999 | Pessier |
| 5,978,644 | A | | 11/1999 | Sato et al. |
| 5,979,571 | A | | 11/1999 | Scott et al. |
| 5,992,547 | A | | 11/1999 | Caraway et al. |

5,992,548 A 11/1999 Silva et al.
6,021,859 A 2/2000 Tibbitts et al.
6,039,131 A 3/2000 Beaton
6,047,239 A 4/2000 Berger et al.
6,050,350 A 4/2000 Morris et al.
6,089,332 A 7/2000 Barr et al.
6,131,675 A * 10/2000 Anderson ..... 175/384
6,150,822 A 11/2000 Hong et al.
6,186,251 B1 2/2001 Butcher
6,202,761 B1 3/2001 Forney
6,213,226 B1 4/2001 Eppink et al.
6,223,824 B1 5/2001 Moyes
6,269,069 B1 7/2001 Ishida
6,269,893 B1 8/2001 Beaton
6,321,858 B1 11/2001 Wentworth et al.
6,340,064 B2 1/2002 Fielder
6,364,034 B1 4/2002 Schoeffler
6,364,038 B1 4/2002 Driver
6,394,200 B1 5/2002 Watson
6,439,326 B1 8/2002 Huang
6,450,269 B1 9/2002 Wentworth et al.
6,454,030 B1 * 9/2002 Findley et al. ..... 76/108.2
6,467,341 B1 10/2002 Boucher et al.
6,474,425 B1 11/2002 Truax
6,484,819 B1 11/2002 Harrison
6,484,825 B2 11/2002 Watson
6,510,906 B1 1/2003 Richert et al.
6,513,606 B1 2/2003 Krueger
6,533,050 B2 3/2003 Molloy
6,594,881 B2 7/2003 Tibbitts
6,601,454 B1 8/2003 Botnan
6,622,803 B2 9/2003 Harvey et al.
6,668,949 B1 12/2003 Rives
6,732,817 B2 5/2004 Dewey
6,789,635 B2 9/2004 Wentworth et al.
6,822,579 B2 11/2004 Goswami et al.
6,880,648 B2 4/2005 Edscer
6,880,649 B2 4/2005 Edscer
6,929,076 B2 8/2005 Fanuel et al.
6,948,572 B2 9/2005 Hay et al.
6,953,096 B2 10/2005 Gledhill et al.
7,104,344 B2 9/2006 Kriesels
7,198,119 B1 * 4/2007 Hall et al. ..... 175/385
7,207,398 B2 4/2007 Runia
7,225,886 B1 * 6/2007 Hall ..... 175/385
7,270,196 B2 * 9/2007 Hall ..... 175/385
7,337,858 B2 * 3/2008 Hall et al. ..... 175/385
7,360,610 B2 * 4/2008 Hall et al. ..... 175/385
7,398,837 B2 * 7/2008 Hall et al. ..... 175/50
7,419,016 B2 * 9/2008 Hall et al. ..... 175/385
7,424,922 B2 * 9/2008 Hall et al. ..... 175/385
7,426,968 B2 * 9/2008 Hall et al. ..... 175/40
7,464,772 B2 * 12/2008 Hall et al. ..... 175/389
7,481,281 B2 1/2009 Schuaf
7,484,576 B2 * 2/2009 Hall et al. ..... 175/104
7,497,279 B2 * 3/2009 Hall et al. ..... 175/73
7,506,706 B2 * 3/2009 Hall et al. ..... 175/385
7,510,031 B2 3/2009 Russell et al.
7,549,489 B2 * 6/2009 Hall et al. ..... 175/385
7,571,780 B2 * 8/2009 Hall et al. ..... 175/385
7,571,782 B2 * 8/2009 Hall et al. ..... 175/432
7,694,756 B2 * 4/2010 Hall et al. ..... 175/385
7,730,975 B2 * 6/2010 Hall et al. ..... 175/324
D620,510 S * 7/2010 Hall ..... D15/139
7,753,144 B2 * 7/2010 Hall et al. ..... 175/385
2003/0213621 A1 11/2003 Britten
2007/0114067 A1 * 5/2007 Hall ..... 175/340
2007/0114068 A1 * 5/2007 Hall et al. ..... 175/61
2007/0119630 A1 * 5/2007 Hall et al. ..... 175/73
2007/0125580 A1 * 6/2007 Hall et al. ..... 175/404
2007/0221406 A1 * 9/2007 Hall et al. ..... 175/431
2007/0221409 A1 * 9/2007 Hall et al. ..... 175/234
2007/0221412 A1 * 9/2007 Hall et al. ..... 175/339
2007/0221415 A1 * 9/2007 Hall et al. ..... 76/108.2
2007/0221416 A1 * 9/2007 Hall et al. ..... 175/381
2007/0221417 A1 * 9/2007 Hall et al. ..... 175/415
2007/0229232 A1 * 10/2007 Hall et al. ..... 340/384.73
2007/0229304 A1 * 10/2007 Hall et al. ..... 340/853.1
2007/0242565 A1 * 10/2007 Hall et al. ..... 175/1
2008/0011521 A1 * 1/2008 Hall et al. ..... 175/432
2008/0011522 A1 * 1/2008 Hall et al. ..... 175/434
2008/0029312 A1 * 2/2008 Hall et al. ..... 175/431
2008/0099243 A1 * 5/2008 Hall et al. ..... 76/108.2
2008/0142264 A1 * 6/2008 Hall et al. ..... 175/45
2008/0142265 A1 * 6/2008 Hall et al. ..... 175/56
2008/0173482 A1 * 7/2008 Hall et al. ..... 175/435
2008/0302572 A1 * 12/2008 Hall et al. ..... 175/317
2008/0314645 A1 * 12/2008 Hall et al. ..... 175/374
2009/0260894 A1 * 10/2009 Hall et al. ..... 175/426
2010/0000799 A1 * 1/2010 Hall et al. ..... 175/426

* cited by examiner

METHOD FOR MANUFACTURING A DRILL BIT

CROSS REFERENCE TO RELATED APPLICATIONS

This patent application is a divisional of U.S. patent application Ser. No. 11/750,700 filed on May 18, 2007 and now U.S. Pat. No. 7,549,489, which is a continuation-in-part of U.S. patent application Ser. No. 11/737,034 filed on Apr. 18, 2007 and now U.S. Pat. No. 7,503,405, which is a continuation-in-part of U.S. patent application Ser. No. 11/686,638 filed on Mar. 15, 2007, now U.S. Pat. No. 7,424,922, which is a continuation-in-part of U.S. patent application Ser. No. 11/680,997 filed on Mar. 1, 2007, now U.S. Pat. No. 7,419,016, which is a continuation-in-part of U.S. patent application Ser. No. 11/673,872 filed on Feb. 12, 2007, now U.S. Pat. No. 7,484,576, which is a continuation-in-part of U.S. patent application Ser. No. 11/611,310 filed on Dec. 15, 2006, now U.S. Pat. No. 7,600,586, which is a continuation-in-part of U.S. patent application Ser. No. 11/278,935 filed on Apr. 6, 2006, now U.S. Pat. No. 7,426,968, which is a continuation-in-part of U.S. patent application Ser. No. 11/277,394 filed on Mar. 24, 2006, now U.S. Pat. No. 7,398,837, which is a continuation-in-part of U.S. patent application Ser. No. 11/277,380 filed on Mar. 24, 2006, now U.S. Pat. No. 7,337,858, which is a continuation-in-part of U.S. patent application Ser. No. 11/306,976 filed on Jan. 18, 2006, now U.S. Pat. No. 7,360,610, which is a continuation-in-part of Ser. No. 11/306,307 filed on Dec. 22, 2005, now U.S. Pat. No. 7,225,886, which is a continuation-in-part of U.S. patent application Ser. No. 11/306,022 filed on Dec. 14, 2005, now U.S. Pat. No. 7,198,119, which is a continuation-in-part of U.S. patent application Ser. No. 11/164,391 filed on Nov. 21, 2005, now U.S. Pat. No. 7,270,196. All of these applications are herein incorporated by reference in their entirety.

BACKGROUND OF THE INVENTION

The present invention relates to the manufacturing of drill bit assemblies for use in oil, gas and geothermal drilling. Drill bit assemblies typically have a number of cutting elements brazed onto a drill bit body. Such cutting elements generally include a diamond surface bonded to a carbide substrate and the carbide substrate is generally brazed into a pocket formed in the drill bit body.

U.S. Pat. No. 4,711,144 to Barr et al., which is herein incorporated by reference for all that it contains, discloses a method of mounting a cutter, having a stud portion defining one end thereof and a cutting formation generally adjacent the other end, in a pocket in a drill bit body member. The method includes the steps of forming a channel extending into the pocket, inserting brazing material into the channel, inserting the stud portion of the cutter assembly into the pocket, then heating the bit body member to cause the brazing material to flow through the channel into the pocket, and finally re-cooling the bit body member. During the assembly of the various pieces required in the steps mentioned immediately above, a spring is used, cooperative between the cutter and the bit body member, to retain the stud portion in the pocket and also to displace the stud portion toward the trailing side of the pocket.

BRIEF SUMMARY OF THE INVENTION

In one aspect of the present invention, a drill bit has a body intermediate a shank and a working face, the working face comprising a plurality of blades armed on the working face and extending outwardly from the bit body. Each blade comprises at least one cutting element. The drill bit also has a jack element coaxial with an axis of rotation and extending out of an opening formed in the working face. A portion of the jack element is coated with a stop-off.

A superhard tip may be bonded to a distal end of the jack element. The superhard tip may comprise a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, metal catalyzed diamond, or combinations thereof. The jack element may have a surface with a concave region. The jack may also comprise a material selected from the group consisting of steel, a refractory metal, carbide, tungsten carbide, cemented metal carbide, niobium, titanium, platinum, molybdenum, diamond, cobalt, nickel, iron, cubic boron nitride, and combinations thereof. The jack element may either be press fit into a steel sleeve bonded to the working face of the drill bit or it may be brazed into or onto the working face of the drill bit.

The stop-off may have a melting point higher than 1000 degrees Celsius. In some embodiments, the stop-off may be boron nitride. However, in other embodiments, the stop-off may comprise a material selected from the group comprising copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, graphite, alumina or combinations thereof. The stop-off may be layered onto the jack element.

In another aspect of the invention, a method has steps for manufacturing a drill bit. A drill bit has a working face and an axis of rotation and a bit body intermediate a shank and the working face. A steel sleeve may be brazed into a pocket formed in the working face of the drill bit. A portion of the jack element may be covered with a stop-off. The stop-off may be applied to the jack element by a process of layering, dipping, spraying, brushing, flow coating, rolling, plating, cladding, silk screen printing, taping, masking or a combination thereof. The jack element may then be press fit into the steel sleeve and at least one cutting element may be brazed onto the working face adjacent the pressed fit jack element.

The stop-off may be boron nitride or it may comprise a material selected from the group comprising copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, or combinations thereof. The material may be combined with an acrylic binder that is dissolved in a solvent in order to form the stop-off. The solvent may comprise xylene, toluene, butyl acetate, or a combination thereof.

The stop-off may be non-wetting to a braze used for bonding the cutting elements onto the working face or the jack element into a pocket formed in the working face. This may be beneficial in that the jack element may be protected from the braze during the manufacturing process. In some applications, the portion of the jack element may be covered with a stop-off comprising a wax or a lacquer. The jack element may have a concave region.

DETAILED DESCRIPTION

Figure 1:
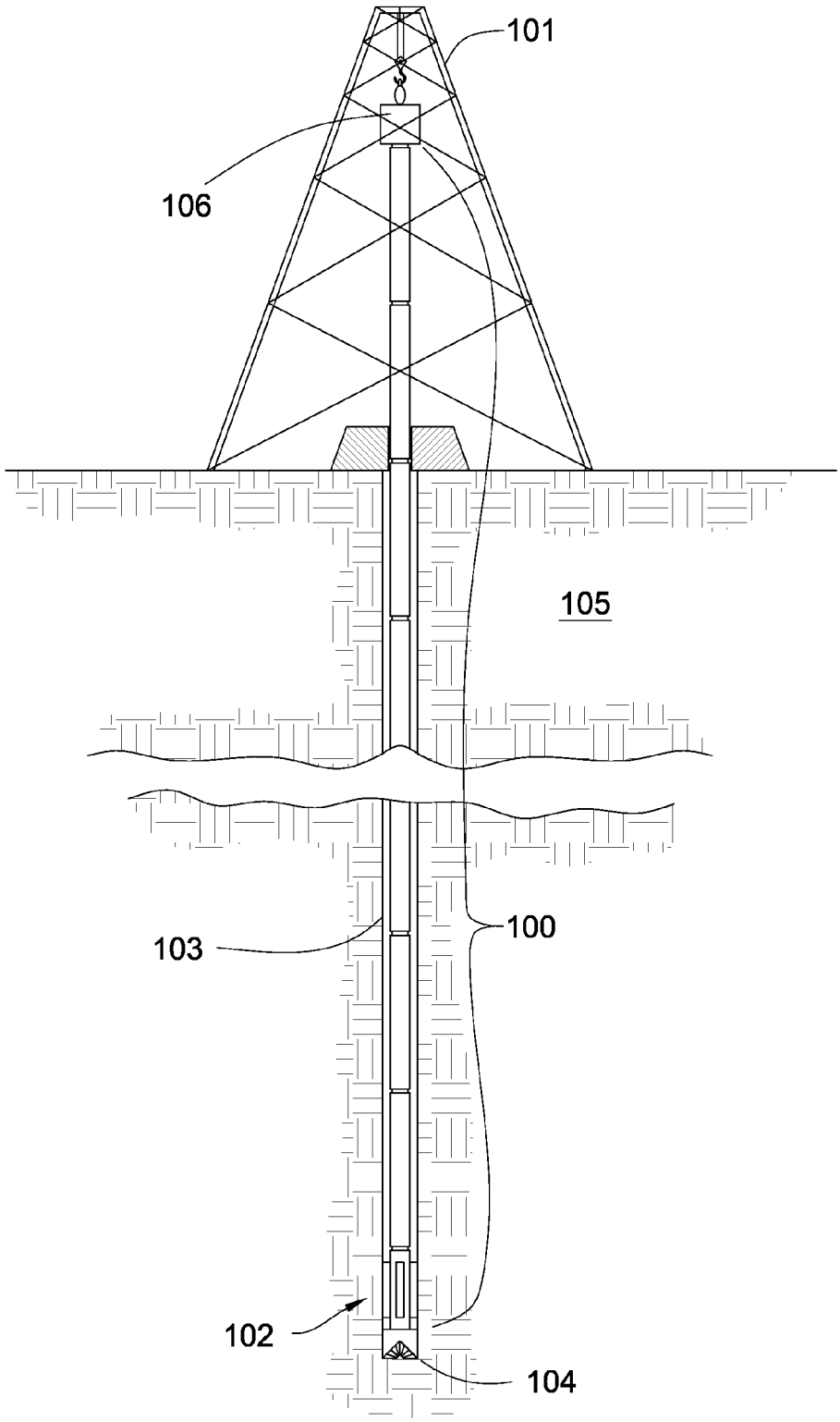
FIG. 1 is a orthogonal diagram of an embodiment of a drill bit suspended in a cross-sectional view of a bore hole.

FIG. 1 is a perspective diagram of an embodiment of a drill string 100 suspended by a derrick 101. A bottom hole assembly 102 is located at a bottom of a bore hole 103 and includes a drill bit 104. As the drill bit 104 rotates downhole, the drill string 100 advances farther into a subterranean formation 105. The drill string 100 may penetrate a subterranean formations 105 that is soft or hard. The bottomhole assembly 102 and/or downhole components may include data acquisition devices which may gather data. The data may be sent to the surface via a transmission system to a data swivel 106. The data swivel 106 may send the data to the surface equipment. Further, the surface equipment may send data and/or power to downhole tools and/or the bottomhole assembly 102. U.S. Pat. No. 6,670,880, which is herein incorporated by reference for all that it contains, discloses a telemetry system that may be compatible with the present invention; however, other forms of telemetry may also be compatible such as systems that include mud pulse systems, electromagnetic waves, radio waves, and/or short hop. In some embodiments, no telemetry system is incorporated into the drill string.

Figure 2:
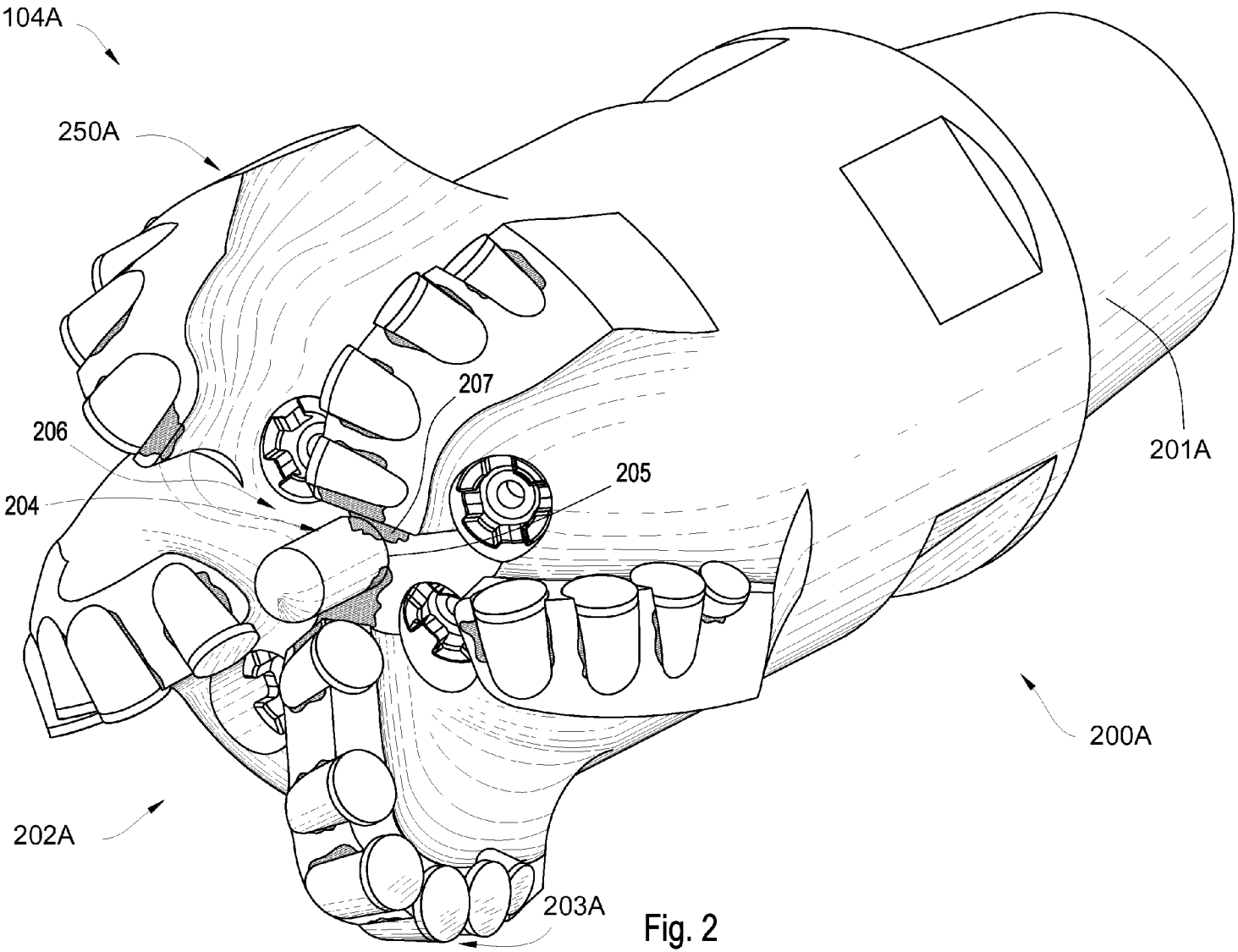
FIG. 2 is a perspective diagram of an embodiment of a drill bit.

In the embodiment of FIG. 2, a drill bit 104A has a bit body 200A between a shank 201A and a working face 202A. A plurality of blades 250A formed on the working face 202A extend outwardly from the bit body 200A, with each blade 250A having at least one cutting element 203A. A jack element 204A extends out of an opening 205A formed in the working face 202A. The jack element 204A may be formed of a material selected from the group consisting of a refractory metal, carbide, tungsten carbide, cemented metal carbide, niobium, titanium, platinum, molybdenum, diamond, cobalt, nickel iron, and cubic boron nitride. In the preferred embodiment, the stop-off may incldues boron nitride.

Figure 3:
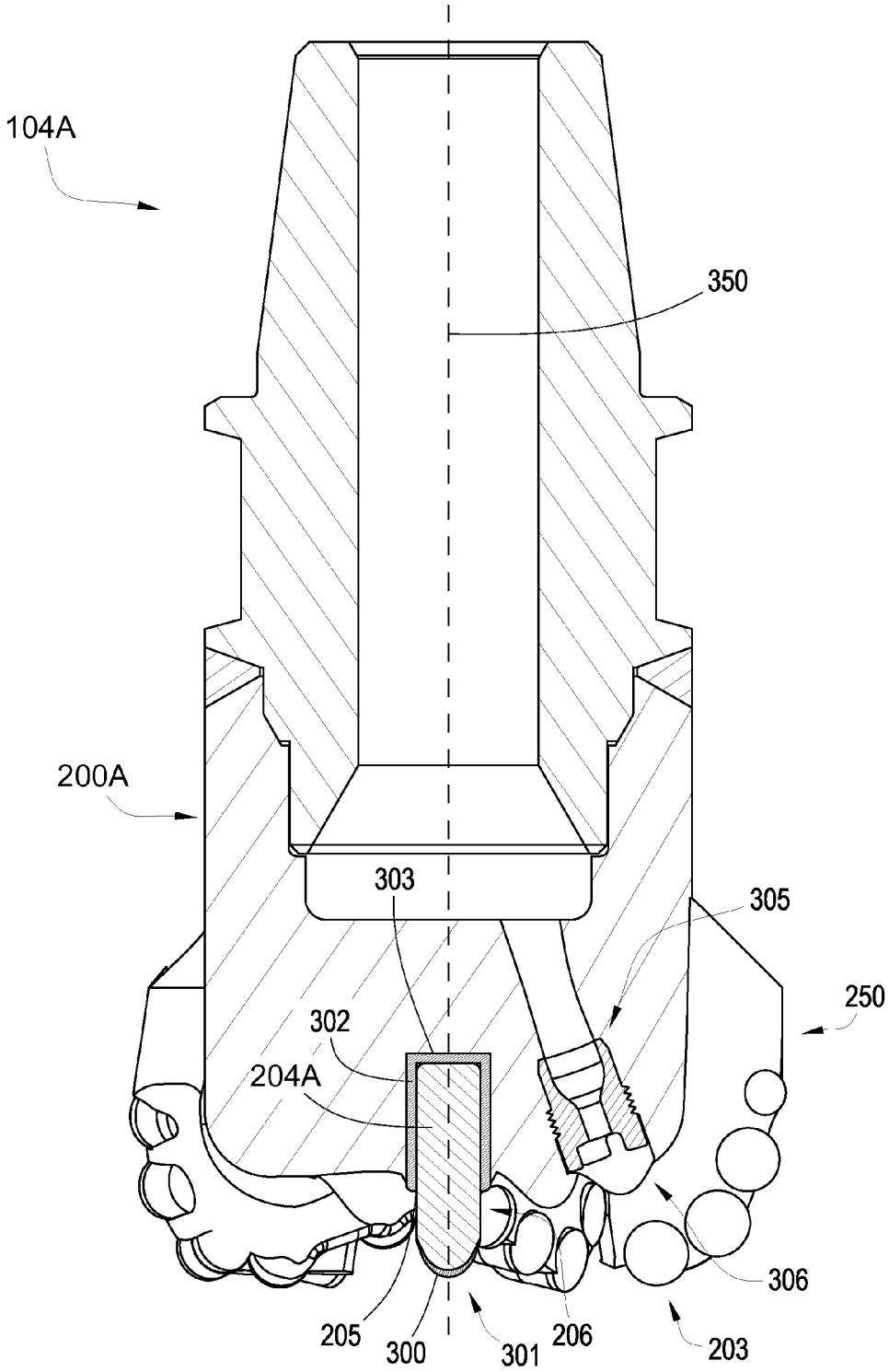
FIG. 3 is a cross-sectional diagram of an embodiment of a drill bit.

Referring now to FIG. 3, jack element 204A is coaxial with an axis of rotation 350A and extends out of the opening 205A formed in the working face 202A of the drill bit 104A. A superhard tip 300A is bonded to a distal end 301A of the jack element 204A and includes a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide and metal catalyzed diamond. The jack element 204A is press fit into a steel sleeve 302A brazed into a pocket 303A formed in the working face 202A of the drill bit 104A. The working face 202A includes the plurality of blades 250A that are formed to extend outwardly from the bit body 200A, each of which may have at least one cutting element 203A. Preferably, the drill bit 104A may have between three and seven blades 250A. A plurality of nozzles 305A may also be fitted into recesses 306A formed in the working face 202B.

During the manufacturing of the drill bit 104A having a jack element 204A, high temperatures may cause excess braze 207A from the cutting elements 203A proximate the jack element 204A to melt and flow onto the jack element 204A. It is believed that in some embodiments, the braze 207 may weaken the jack element 204 and contribute to damage of the jack element 204 in a downhole drilling operation. A portion 206A of the jack element 204A is coated with a stop-off in order to protect the jack element 204A from the braze 207A used to braze the cutting elements 203A onto the plurality of blades 250A. In some embodiments, the stop-off covers a portion 206A of the jack element 204A extending out of the opening 205A formed in the working face 202A. In other embodiments, the stop-off covers the whole jack element 204A. The stop-off has a melting temperature higher than 1000 degrees Celsius. This is necessary because of the high temperatures the drill bit 104A is exposed to during the manufacturing process. Preferably, the melting temperature of the stop-off is higher than a melting temperature of the braze 207A.

Figure 3A:
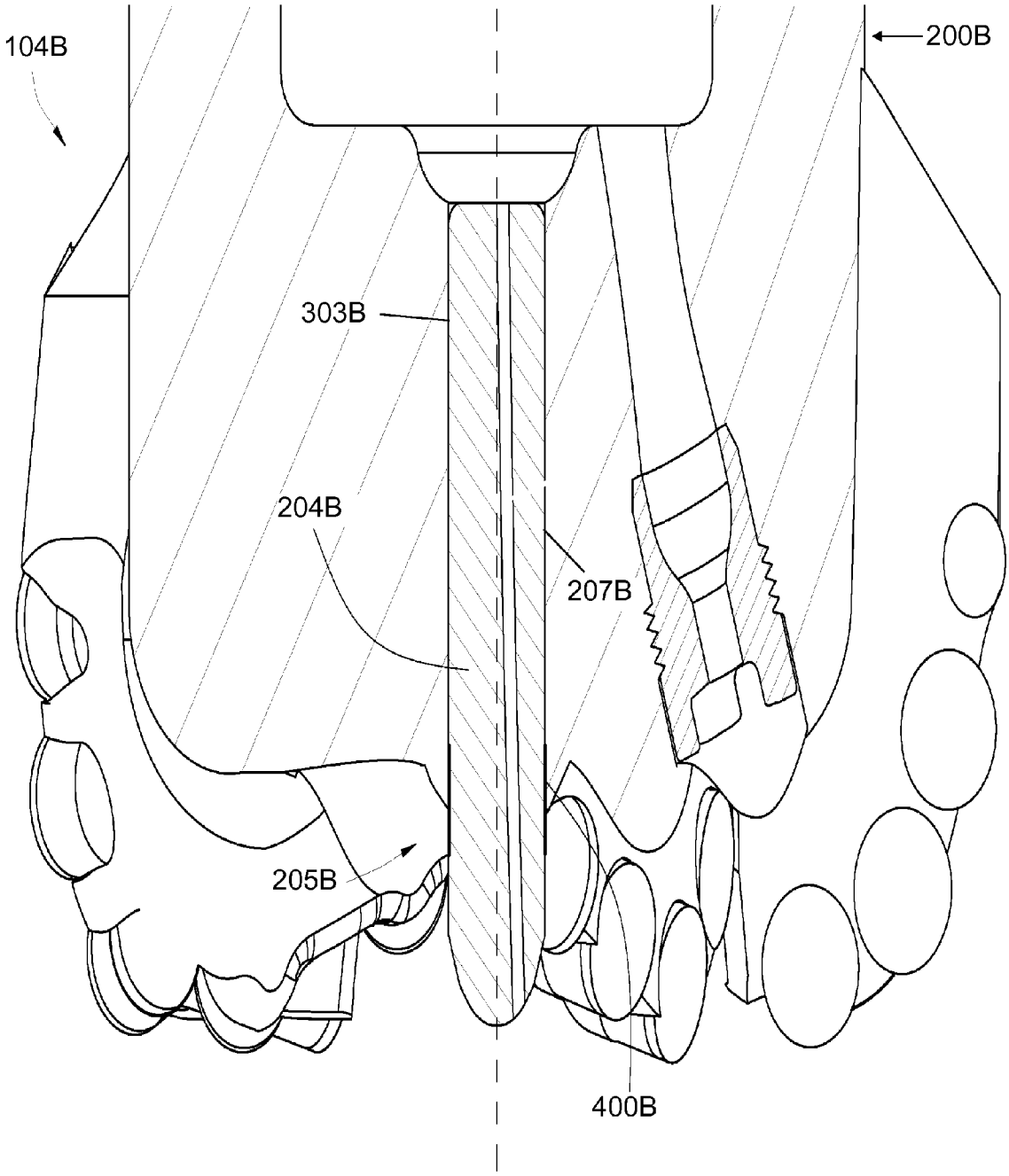
FIG. 3*a* is a cross-sectional diagram of another embodiment of a drill bit.

FIG. 3*a* discloses an embodiment of a drill bit 104B with a jack element 204B brazed directly to the bit body 200B. A stop-off 400B is coated onto the portion of the jack element 204B below and above an opening 205B of a pocket 303B. The braze 207B is allowed to bond a majority of the surface area of the jack element 204B to the wall of the pocket 303B, but not the portion of the jack element 204B proximate the opening 205B of the pocket 303B. In some embodiments of the invention, the jack element 204B may have a plurality of fluid holes. These holes may also be protected from braze material with a stop-off. In some embodiments, the stop-off may actually plug off the fluid holes during manufacturing.

FIGS. 4 through 7 illustrate different embodiments of a jack element 204C, 204D, 204E, 204F extending out of an opening 205C, 205D, 205E, 205F formed in a working face 202C, 202D, 202E, 202F of a drill bit 104C, 104D, 104E, 104F. The jack element 204C, 204D, 204E, 204F is press fit into a steel sleeve 302C, 302D, 302E, 302F, the steel sleeve 302C, 302D, 302E, 302F being bonded to the working face 202C, 202D, 202E, 202F of the drill bit 104C, 104D, 104E, 104F. The steel sleeve 302C, 302D, 302E, 302F is brazed within a pocket 303C, 303D, 303E, 303F formed into the working face 202C, 202D, 202E, 202F. A stop-off 400C, 400D, 400E, 400F may cover a portion 206C, 206D, 206E, 206F of the jack element 204C, 204D, 204E, 204F. In some embodiments, the stop-off 400C, 400D, 400E, 400F comprises boron nitride. In other embodiments, the stop-off may comprise a material selected from the group consisting of copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, graphite, and alumina. The stop-off 400C, 400D, 400E, 400F may be formed by combining an aforementioned material with an acrylic binder dissolved in a solvent. The solvent may comprise xylene, toluene, butyl acetate, hydrocarbons, or a combination thereof. The solvents and binders used in forming the stop-off 400C, 400D, 400E, 400F may be dependant on the method of applying the stop-off 400C, 400D, 400E, 400F as well as the material composition of the jack element 204C, 204D, 204E, 204F. The stop-off 400C, 400D, 400E, 400F may be non-wetting to a material used to braze the cutting elements 203C, 203D, 203E, 203F onto the working face 202C, 202D, 202E, 202F. It is believed that the stop-off 400C, 400D, 400E, 400F may protect the jack element 204C, 204D, 204E, 204F from thermal fluctuations during the manufacturing process. Thermal fluctuations may be caused by the molten braze contacting the jack element 204C, 204D, 204E, 204F, causing the jack element 204C, 204D, 204E, 204F to expand and constrict with the changing temperatures, thus weakening the jack element 204C, 204D, 204E, 204F.

Figure 4:
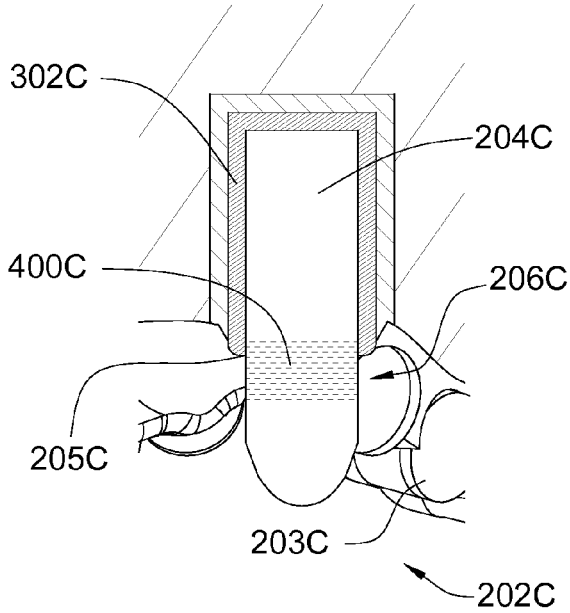
FIG. 4 is a cross-sectional diagram of another embodiment of a drill bit.

In the embodiment of FIG. 4, a stop-off 400C may cover a portion 206C of the jack element 204C nearest the cutting elements 203C. The portion 206C of the jack element 204C extending out of the drill bit may be more prone to contact with a braze from the cutting elements 203C than other portions of the jack element 204C.

Figure 5:
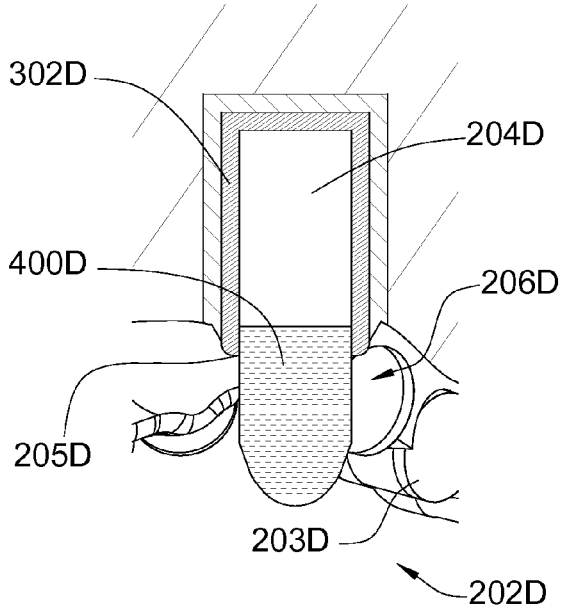
FIG. 5 is a cross-sectional diagram of another embodiment of a drill bit.

However, as shown in the embodiment of FIG. 5, it may be beneficial to cover a larger portion 206D of the jack element 204D with the stop-off 400D to ensure that the portion 206D of the jack element 204D is protected.

Figure 6:
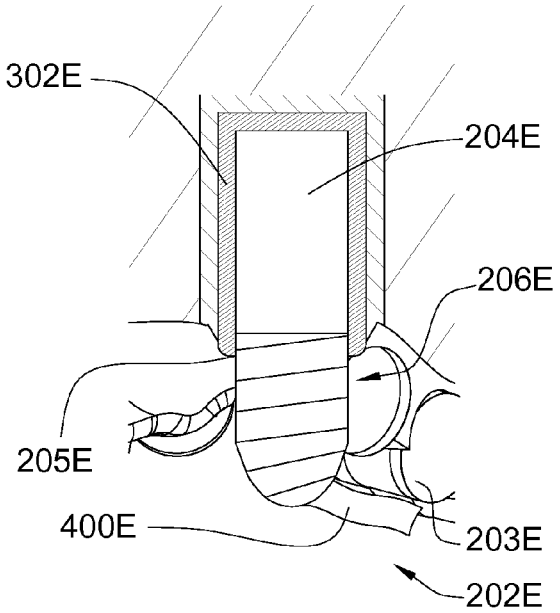
FIG. 6 is a cross-sectional diagram of another embodiment of a drill bit.

In the embodiment of FIG. 6, the stop-off 400E may be applied to the jack element 204E by taping. In other embodiments, the stop-off 400E may be applied to the jack element 204E by a process of layering, dipping, spraying, brushing, flow coating, rolling, plating, cladding, silk screen printing, masking or a combination thereof.

Figure 7:
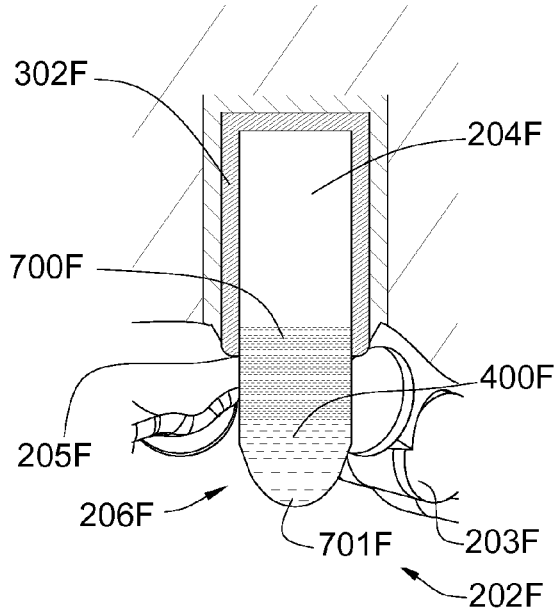
FIG. 7 is a cross-sectional diagram of another embodiment of a drill bit.

FIG. 7 shows a jack element 204F in which the stop-off 400F is layered. In this embodiment, the stop-off 400F may be thicker at one segment 700F of the jack element 204F than at another segment 701F of the jack element 204F. The amount of stop-off 400F used to cover a portion 206F of the jack element 204F may vary along the jack element 204F. Layers may be beneficial when the stop-off 400F does not bond well to the portion 206F of the jack element 204F. In such a case, the undermost layer of the stop-off 400F may form a good bond with the stop-off 400F and the jack element 204F.

Figure 8:
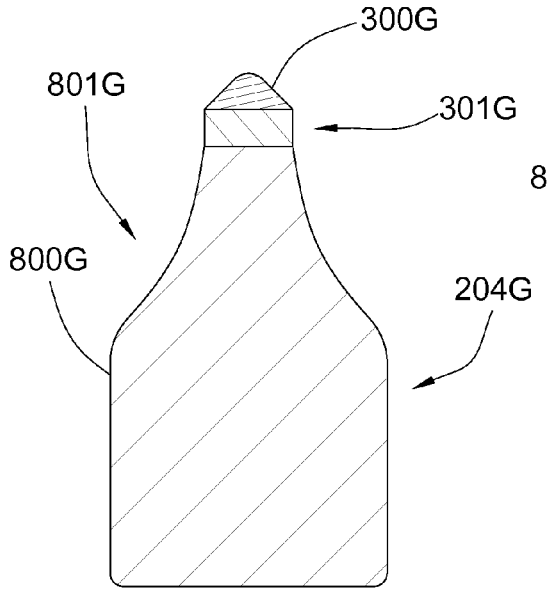
FIG. 8 is a cross-sectional diagram of an embodiment of a jack element.
Figure 9:
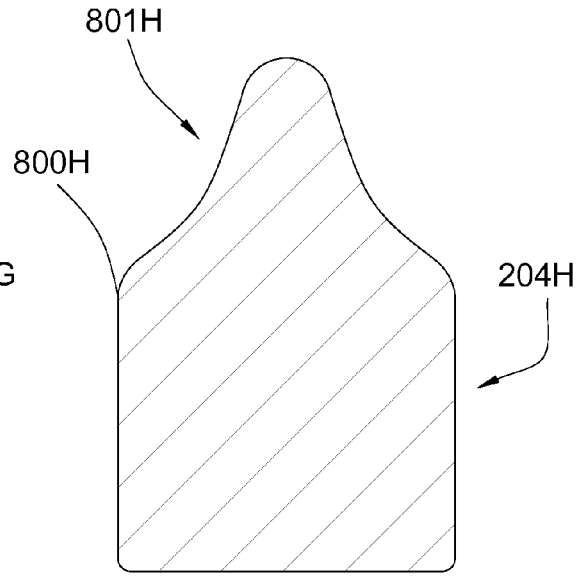
FIG. 9 is a cross-sectional diagram of another embodiment of a jack element.
Figure 10:
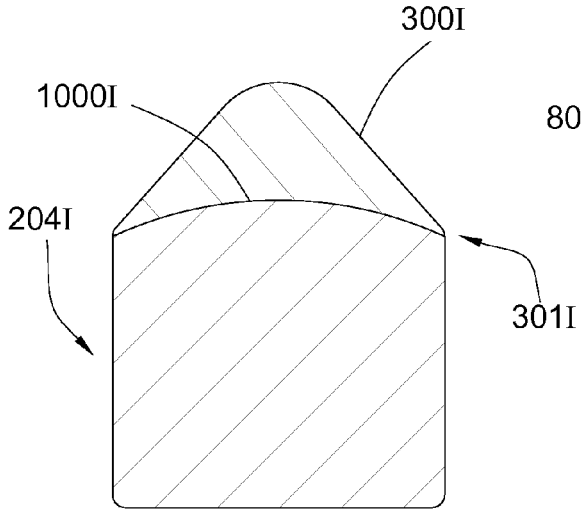
FIG. 10 is a cross-sectional diagram of another embodiment of a jack element.
Figure 11:
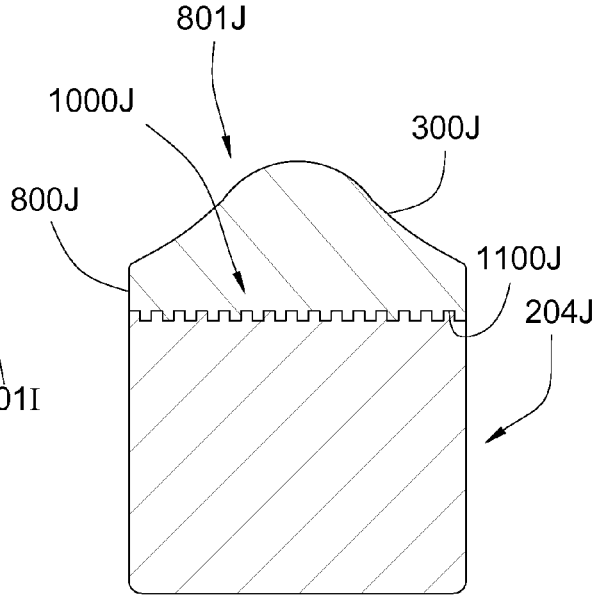
FIG. 11 is a cross-sectional diagram of another embodiment of a jack element.

FIGS. 8 through 11 show various embodiments of a jack element 204G. In some embodiments, a jack element 204G, 204H, 204I, 204J may have a surface 800G, 800H, 800J with a concave region 801G, 801H, 801J, as shown in FIGS. 8, 9, and 11. In such embodiments, it is believed that forces exerted on the jack element 204G, 204H, 204J may be more evenly distributed throughout the jack element 204G, 204H, 204J.

In the embodiment of FIG. 8, a superhard tip 300G may be bonded to a distal end 301G of the jack element 204G, the tip including a material selected from the group consisting of diamond, polycrystalline diamond, natural diamond, synthetic diamond, vapor deposited diamond, silicon bonded diamond, cobalt bonded diamond, thermally stable diamond, infiltrated diamond, layered diamond, monolithic diamond, polished diamond, course diamond, fine diamond, cubic boron nitride, diamond impregnated matrix, diamond impregnated carbide, and metal catalyzed diamond. The jack element 204G may include a material selected from the group consisting of a refractory metal, carbide, tungsten carbide, cemented metal carbide, niobium, titanium, platinum, molybdenum, diamond, cobalt, nickel, iron, and cubic boron nitride.

In the embodiment of FIG. 9, the jack element 204H does not have a superhard tip. In this embodiment, the jack element 204H includes surface 800H with a concave region 801H.

FIG. 10 discloses an embodiment of a jack element 204I with a superhard tip 300I bonded to the distal end 301I of the jack element 204I. The superhard tip 300I includes a flat-sided thick, sharp geometry as well as a curved interface 1000I between the superhard tip 300I and the jack element 204I.

FIG. 11 depicts a jack element 204J with a superhard tip 300J attached to the distal end 301J of the jack element 204J. Nodules 1100J may be incorporated at the interface 1000J between the superhard tip 300J and the jack element 204J, which may provide more surface area on the jack element 204J to provide a stronger interface. This embodiment also shows a jack element 204J having a surface 800J with a concave region 801J.

Figure 12:
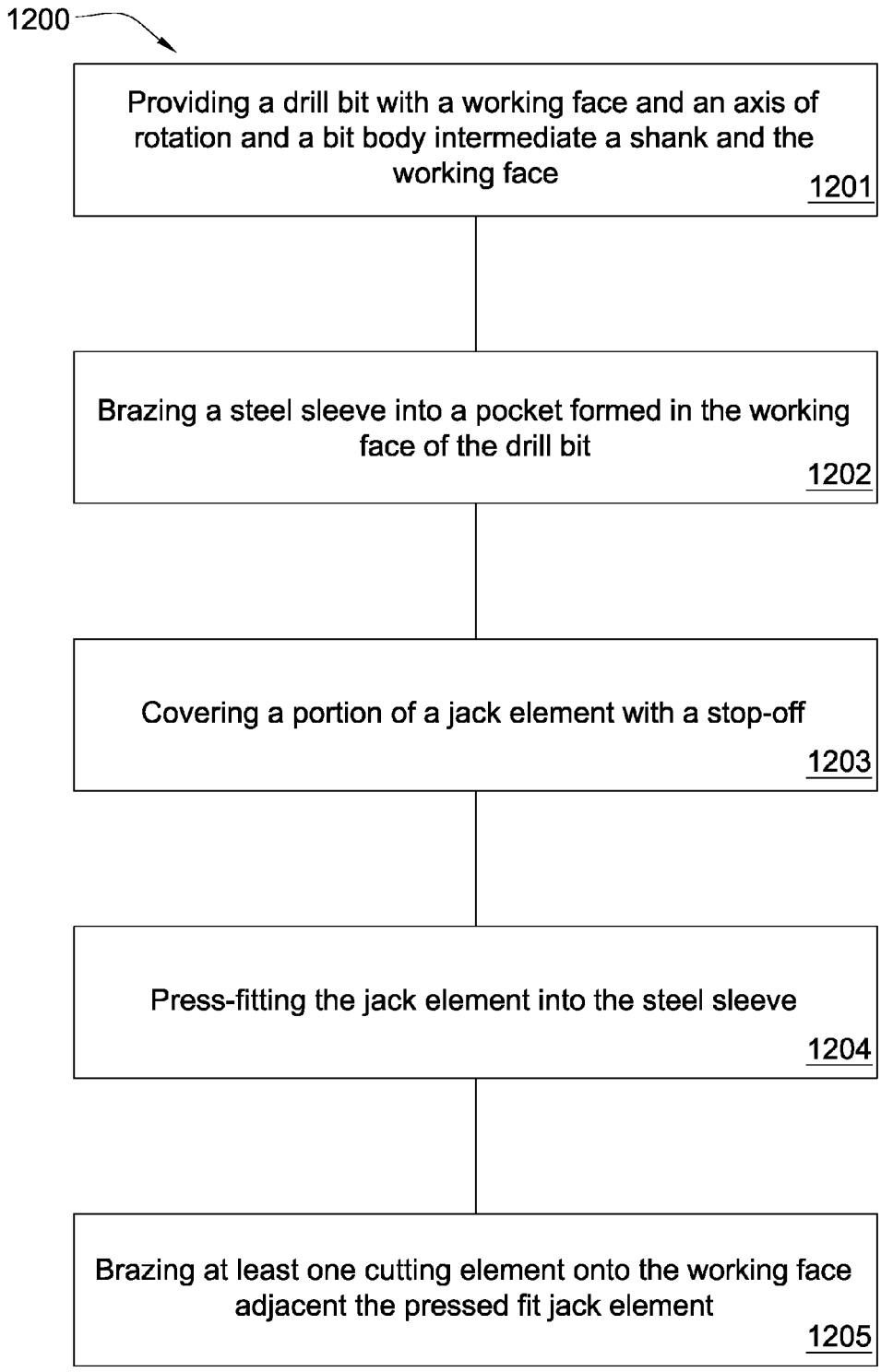
FIG. 12 is a diagram of an embodiment of a method for manufacturing a drill bit.

FIG. 12 is a diagram of an embodiment of a method 1200 for manufacturing a drill bit. The method 1200 includes providing 1201 a drill bit with a working face and an axis of rotation and a bit body intermediate a shank and the working face. The method 1200 also includes brazing 1202 a steel sleeve into a pocket formed in the working face of the drill bit. The method 1200 further includes covering 1203 a portion of a jack element with a stop-off. The stop-off preferably comprises boron nitride. However, it may comprise copper, nickel, cobalt, gold, silver, manganese, magnesium, palladium, titanium, niobium, zinc, phosphorous, boron, aluminum, cadmium, chromium, tin, silicon, tantalum, yttrium, metal oxide, ceramic, or combinations thereof. Covering a portion of the jack element with a stop-off may include applying a wax or lacquer to the portion. The stop-off may be applied to the jack element by a process of layering, dipping, spraying, brushing, flow coating, rolling, plating, cladding, silk screen printing, taping, masking or a combination thereof. The method also includes press fitting 1204 the jack element into the steel sleeve and brazing 1205 at least one cutting element onto the working face adjacent the pressed fit jack element. The stop-off may be non-wetting to a material used in brazing the cutting elements onto the working face.

Figure 13:
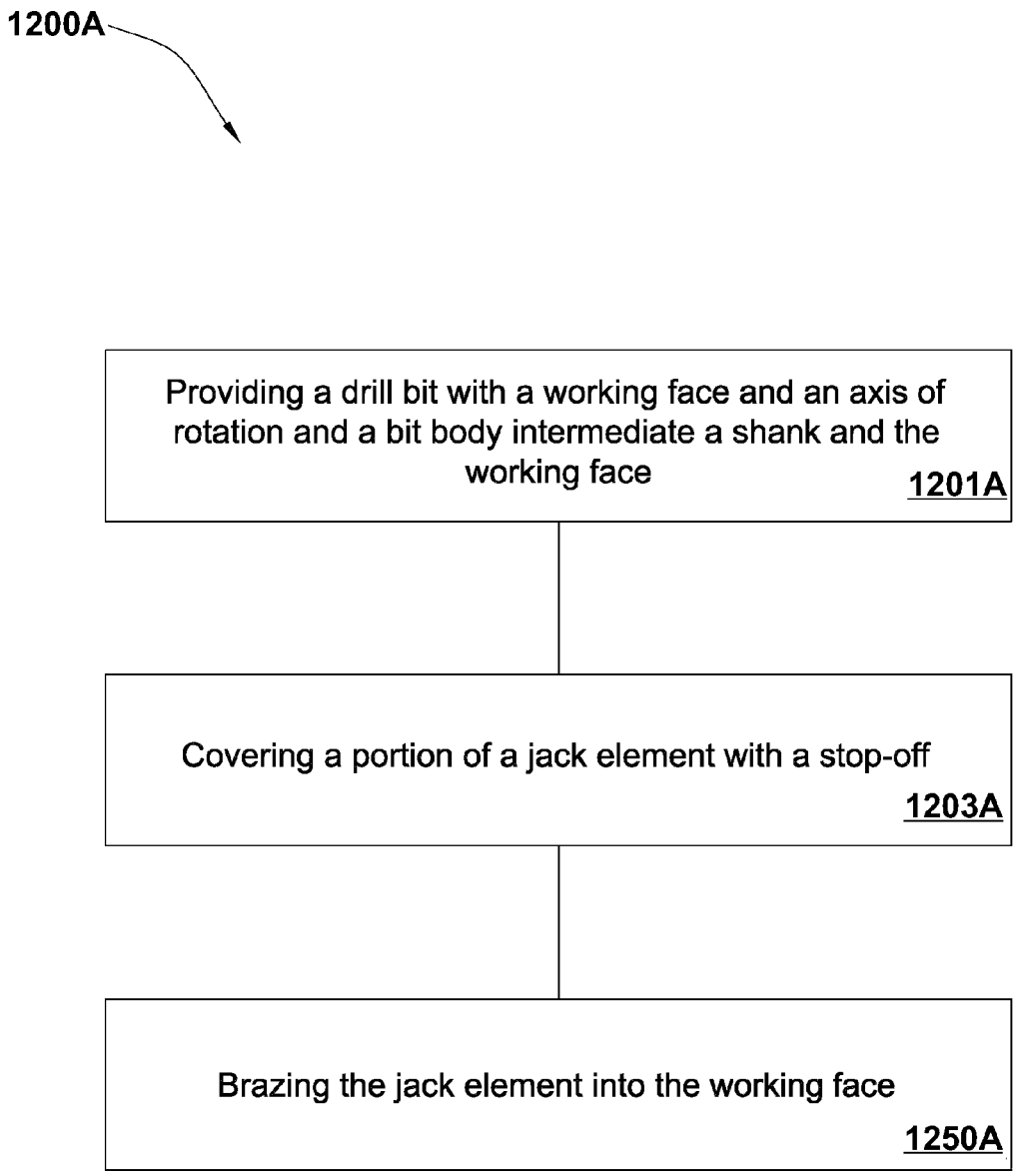
FIG. 13 is a diagram of another embodiment of a method for manufacturing a drill bit.

In FIG. 13, another method 1200*a* is disclosed. The method 1200*a* may comprise the steps of providing 1201*a* a drill bit with a working face and an axis of rotation and a bit body intermediate a shank and the working face; covering 1203*a* a portion of a jack element with a stop-off, and brazing 1250*a* the jack element into the working face.

Whereas the present invention has been described in particular relation to the drawings attached hereto, it should be understood that other and further modifications apart from those shown or suggested herein, may be made within the scope and spirit of the present invention.

What is claimed is:

1. A method for manufacturing a drill bit assembly, the method comprising the steps of:

providing a drill bit with a working face, a shank, and a bit body between said working face and said shank, said drill bit having a pocket formed in said working face of said drill bit and an axis of rotation;

providing a steel sleeve;

brazing said steel sleeve into said pocket;

providing a jack element;

covering a portion of said jack element with a stop-off;

press fitting said jack element into said steel sleeve; and brazing at least one cutting element onto said working face adjacent said jack element.

2. The method of claim 1, wherein said stop-off is boron nitride.

3. The method of claim 1, wherein said stop-off is a material selected from the group consisting of copper, nickel, cobalt, gold, silver, manganese, magnesium, palladium, titanium, niobium, zinc, phosphorous, boron, aluminum, cadmium, chromium, tin, silicon, tantalum, yttrium, metal oxide, and ceramic.

4. The method of claim 3, wherein said stop-off is formed by combining said material with an acrylic binder dissolved in a solvent.

5. The method of claim 4, wherein said solvent is selected from the goup consisting of xylene, toluene, butyl acetate, and hydrocarbons.

6. The method of claim 1, wherein said stop-off is non-wetting to a material used to braze said cutting elements onto said working face.

7. The method of claim 1, wherein said jack element has a concave region.

8. The method of claim 1, wherein said step of covering a portion of said jack element with a stop-off includes applying a wax or lacquer to said portion.

9. The method of claim 1, wherein said stop-off is applied to said jack element by a process selected from the group consisting of layering, dipping, spraying, brushing, flow coating, rolling, plating, cladding, silk screen printing, taping, and masking.

10. The method of claim 1, wherein a distal end of said jack element extends beyond said working face.

11. The method of claim 1, wherein said jack element comprises at least one fluid hole.

12. The method claim 11, wherein said at least one fluid hole is protected with a stop-off.

13. The method of claim 1, wherein said jack element is coaxial with said axis of rotation of said drill bit.

14. The method of claim 1, wherein a diamond layer is bonded to a distal end of said jack element.

15. The method of claim 1, wherein said stop-off is applied in layers.

16. The method of claim 15, wherein said layers are different compositions.

17. The method of claim 1, wherein said step of covering the jack with stop off includes a process selected from the group consisting of dipping, spraying, brushing, flow coating, rolling, plating, cladding, silk screen printing, and masking.

* * * * *